US008047531B1

(12) United States Patent
Liao et al.

(10) Patent No.: US 8,047,531 B1
(45) Date of Patent: Nov. 1, 2011

(54) SHEET PRESSING APPARATUS WITH SENSOR UNIT AND STEPPING MOTOR

(75) Inventors: Wen-Ching Liao, Taipei (TW); Lung Chen, Taipei (TW)

(73) Assignee: Foxlink Image Technology Co., Ltd., Taipei (TW)

( * ) Notice: Subject to any disclaimer, the term of this patent is extended or adjusted under 35 U.S.C. 154(b) by 0 days.

(21) Appl. No.: 13/005,236

(22) Filed: Jan. 12, 2011

(51) Int. Cl.
*B65H 1/00* (2006.01)

(52) U.S. Cl. ..... 271/117; 217/110

(58) Field of Classification Search ..... 271/110, 271/117, 265.04
See application file for complete search history.

(56) References Cited

U.S. PATENT DOCUMENTS 6,308,951 B1 * 10/2001 Allmendinger et al. . 271/265.04
2003/0132568 A1 * 7/2003 Garcia et al. ..... 271/117
* cited by examiner

*Primary Examiner* — Stefanos Karmis
*Assistant Examiner* — Gerald McClain
(74) *Attorney, Agent, or Firm* — WPAT, P.C.; Anthony King

(57) ABSTRACT

A sheet pressing apparatus assembled to a file processing equipment which has an input tray for stacking sheets and a pickup roller for feeding sheets. The sheet pressing apparatus includes a sheet pressing assembly movably mounted to the file processing equipment, a driving device including a connecting member and a stepping motor, a sensor unit and a control system. The sheet pressing assembly is driven by the stepping motor to be descending through the connecting member. When the sheet pressing assembly descends, the sensor unit touches the sheets and sends a signal to the control system, the control system figures out the thickness of the sheets by calculating steps the stepping motor having passed, then the control system makes the stepping motor further move with certain steps to drive the sheet pressing assembly further descend to apply a suitable pressure on the sheets.

3 Claims, 5 Drawing Sheets

SHEET PRESSING APPARATUS WITH SENSOR UNIT AND STEPPING MOTOR

BACKGROUND OF THE INVENTION

1. Field of the Invention

The present invention relates to a sheet pressing apparatus, and more particularly to a sheet pressing apparatus capable of adjusting the pressure applied on the sheets.

2. The Related Art

Referring to FIGS. 8-9, a conventional sheet pressing apparatus 100' is assembled to a file processing equipment (not shown). The file processing equipment has a main shell (not shown), a stepping motor (not shown) driving the sheet pressing apparatus 100', an input tray 300' for stacking the sheets 200', a pickup roller 400'. The sheet pressing apparatus 100' has a sheet pressing assembly 10', a plurality of rollers 11' mounted to the sheet pressing assembly 10', a connecting element 20' for connecting the stepping motor, and the sheet pressing assembly 10'. The stepping motor drives connecting element 20' to generate a torque, the torque is applied on the sheet pressing assembly 10' to drive the sheet pressing assembly 10' to descend and apply a pressure on the sheets 200'. However, the pressure applied on the sheets 200' is not controllable. As the thickness of the sheets 200' increase, the pressure also increase, which brings difficult to separate the sheets 200' by the pickup roller 400'.

SUMMARY OF THE INVENTION

Accordingly, an object of the present invention is to provide a sheet pressing apparatus assembled on a file processing equipment. The file processing equipment has an input tray for stacking sheets and a pickup roller for feeding sheets. The sheet pressing apparatus has a sheet pressing assembly, a driving device, a sensor unit and a control system. The sheet pressing assembly is movably mounted to the file processing equipment. The driving device includes a connecting member and a stepping motor, the connecting member is capable of making the sheet pressing assembly descend to press the sheets by a portion thereof with a force under the drive of the stepping motor. The sensor unit is assembled to the sheet pressing assembly. The control system electrically connects with the stepping motor and the sensor unit. When the sheet pressing assembly descends, the sensor unit touches the sheets before the sheet pressing assembly touches the sheets and sends a signal to the control system, the control system figures out the thickness of the sheets by calculating steps the stepping motor having passed, then the control system makes the stepping motor further move with certain steps to drive the sheet pressing assembly further descend to apply a suitable pressure on the sheets.

As described above, the sensor detects the thickness of the sheets and gives the control system a signal, the control system makes the stepping motor further going a certain time making the holding shell keep descending and giving the sheets a suitable pressure.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
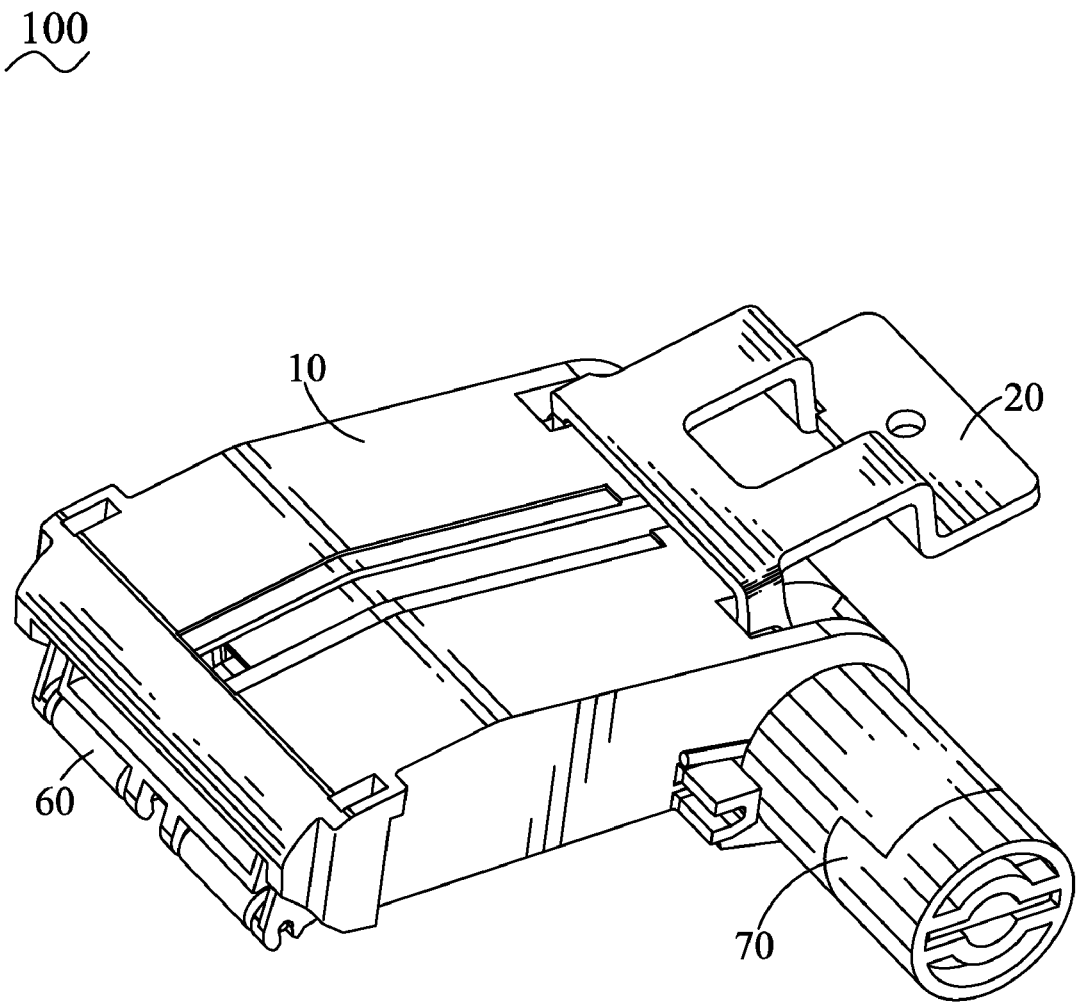
FIG. 1 is an assembled, perspective view of a sheet pressing apparatus of an embodiment in accordance with the present invention.
Figure 2:
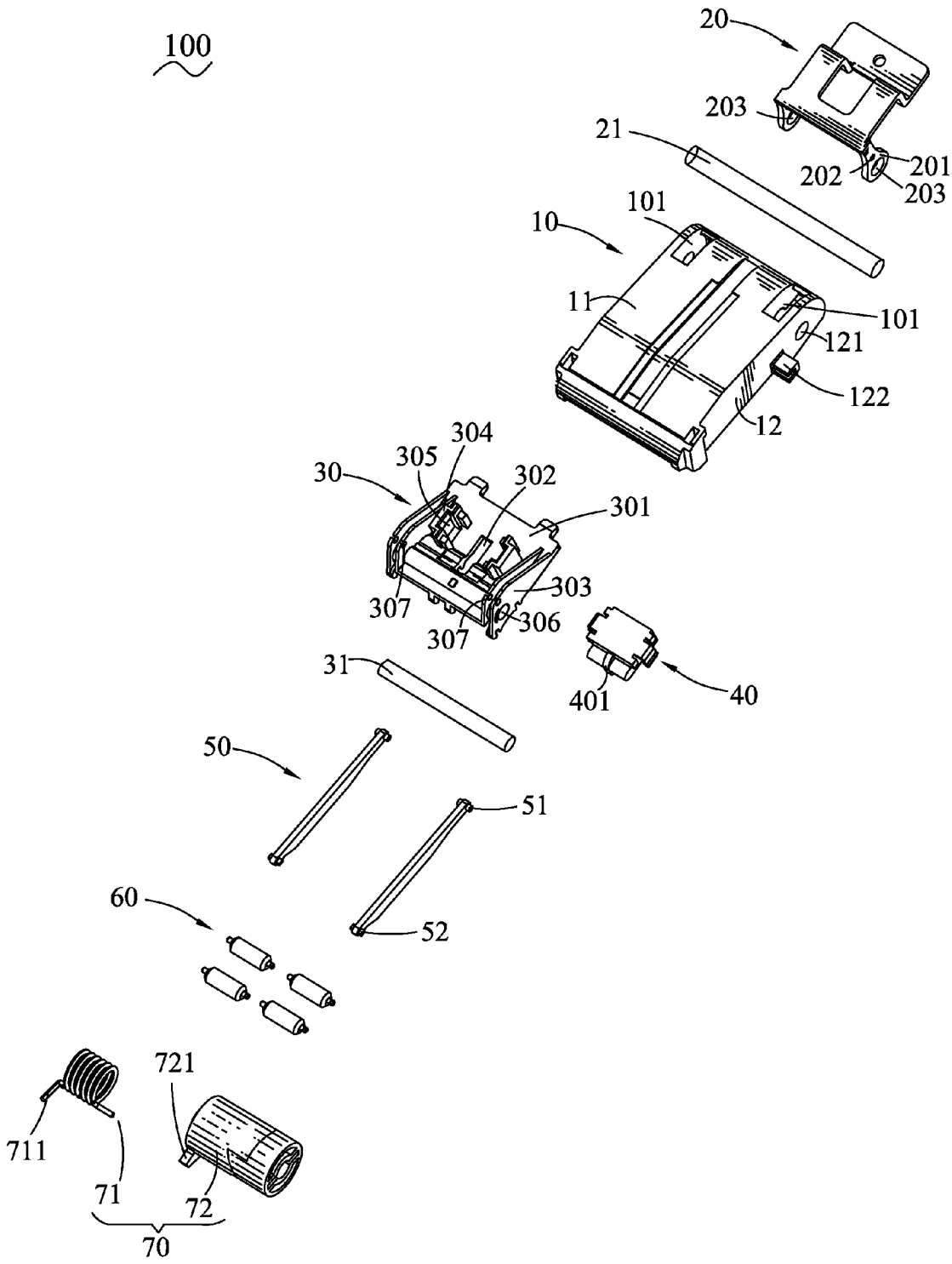
FIG. 2 is an exploded, perspective view of the sheet pressing apparatus shown in FIG. 1.
Figure 5:
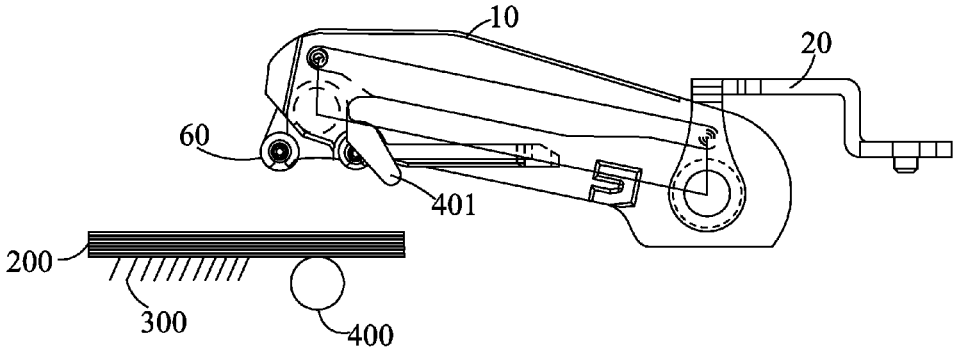
FIG. 5 is a lateral view of an original state of the sheet pressing apparatus.
Figure 6:
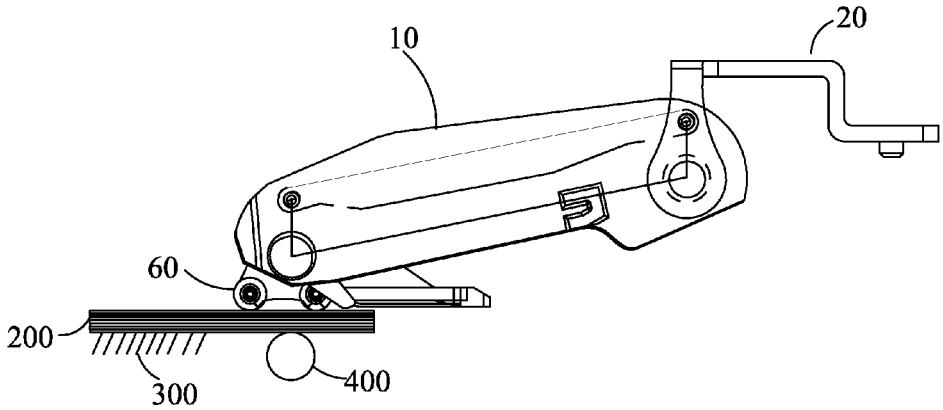
FIG. 6 is a lateral view of a final state of the sheet pressing apparatus.
Figure 7:
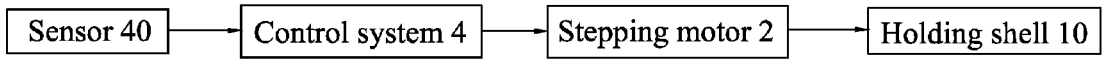
FIG. 7 is a flow chart showing a controlling process of the sheet pressing apparatus.
Figure 8:
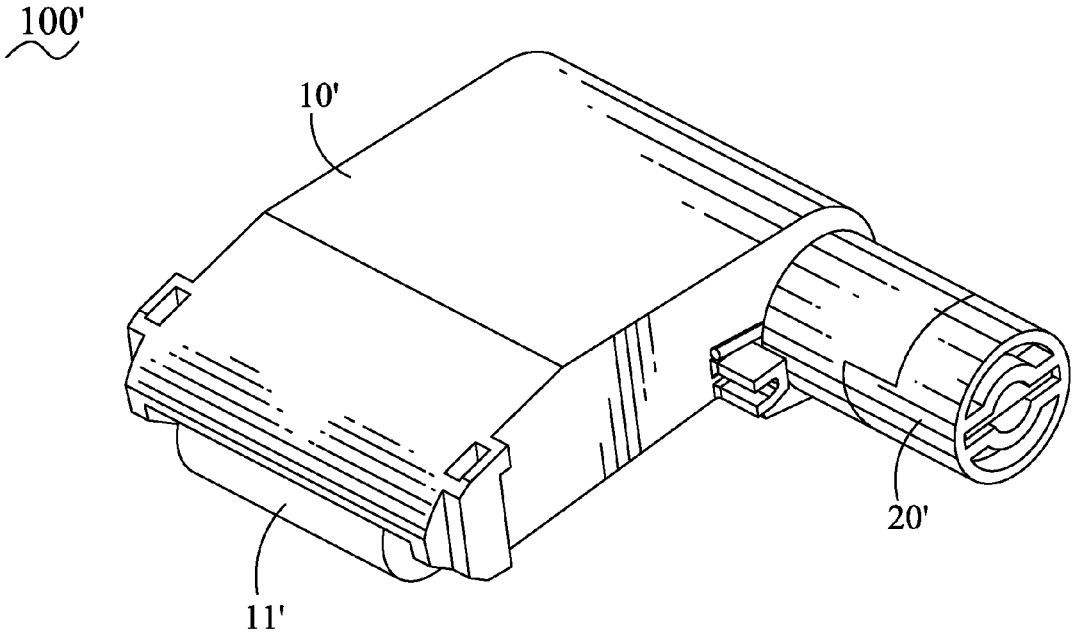
FIG. 8 (Prior Art)
FIG. 8 is a perspective view of a conventional sheet pressing apparatus.
Figure 9:
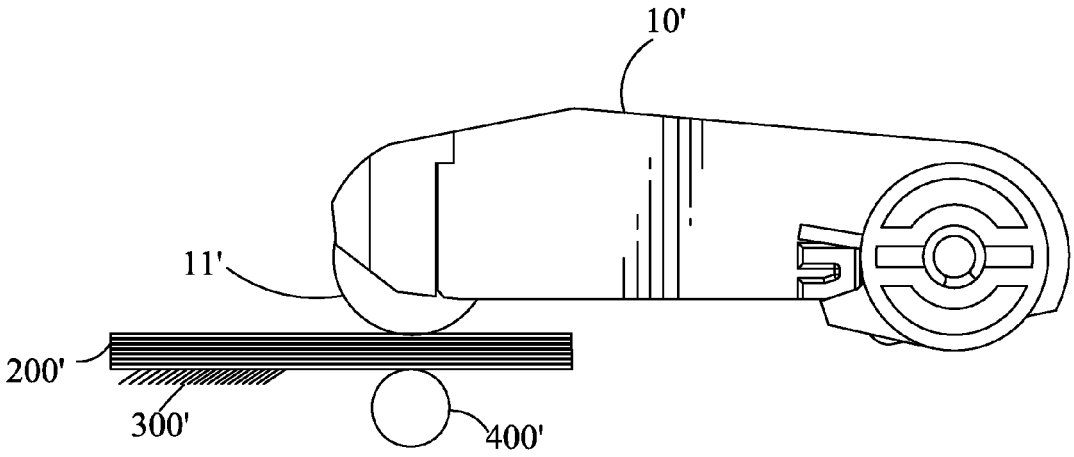
FIG. 9 (Prior Art)
FIG. 9 is a perspective view of the conventional sheet pressing apparatus in the working state.

Referring to FIGS. 1-2 conjunction with FIGS. 5-7, the embodiment of the invention is embodied in a sheet pressing apparatus 100. The sheet pressing apparatus 100 is assembled to a file processing equipment (not shown). The file processing equipment has a main shell (not shown), an input tray 300 for stacking a plurality of sheets 200, and a pickup roller 400 swinging clockwise for transferring a sheet 200 forward. The sheet pressing apparatus 100 includes a sheet pressing assembly, a driving device, a sensor unit and a control system 4. The sheet pressing assembly includes a holding shell 10 which contains the sensor unit, pressing rollers 60 mounted to a front end of the holding shell 10 and a holding member 20 having a front thereof pivotally mounted in a rear of the holding shell 10 and a rear thereof fixed to the file processing equipment. The driving device includes a stepping motor 2 driving the holding shell 10 ascending or descending and a connecting member 70 connected to a lateral side of the holding shell 10. The sensor unit includes a sensor 40, a sensor holder 30 for holding the sensor 40. A pair of connecting rods 50 assembled in the holding shell 30 pivotally connects the holding member 20 and the sensor holder 30.

Figure 3:
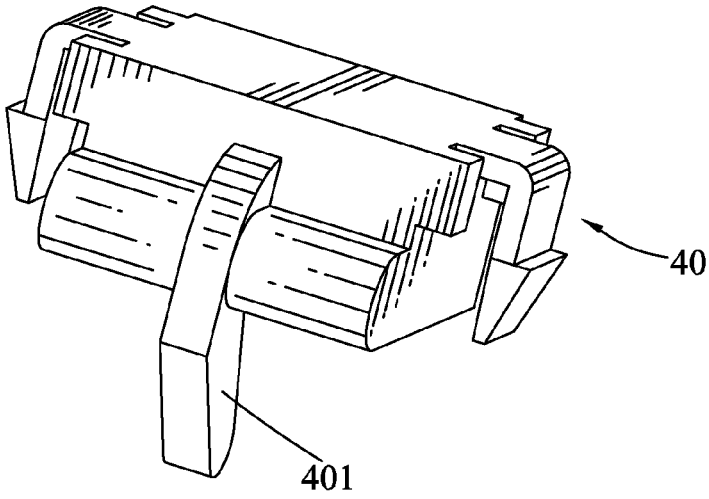
FIG. 3 is a perspective view of a sensor shown in FIG. 2.
Figure 4:
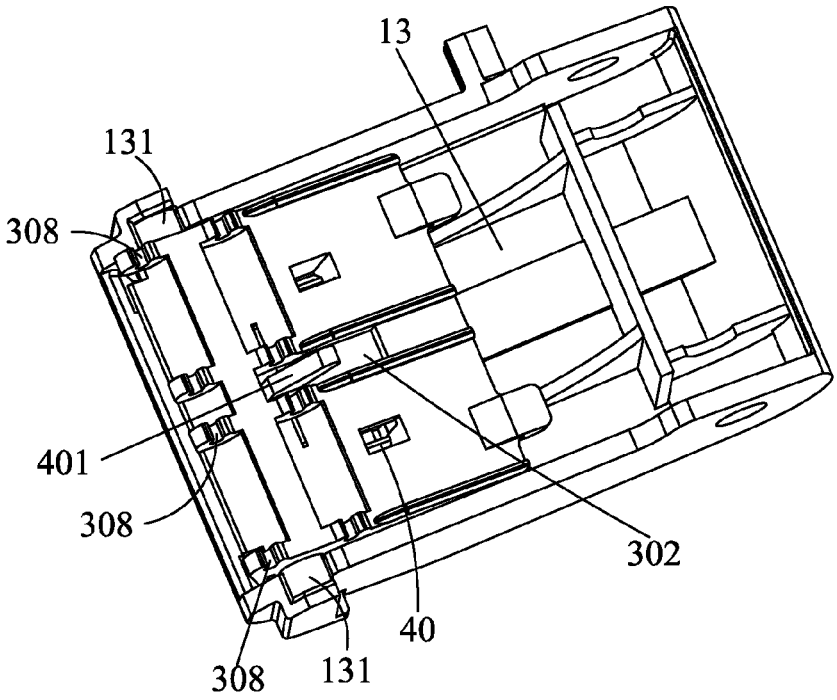
FIG. 4 is a perspective view showing a sensor assembled in a sensor holder shown in FIG. 2.

With reference to FIGS. 2-4, the holding shell 10 has a long rectangular top wall 11 and a pair of lateral walls 12. The lateral walls 12 cooperate with the top wall 11 to define a receiving cavity 13 for receiving the sensor holder 30. The top wall 11 defines a pair of through slots 101 symmetrically located at a rear thereof. A rear of each lateral wall 11 defines a first hole 121 communicating with the through slots 101. A middle portion of one lateral wall 12 protrudes outward to form a projection 122 adjacent to the first hole 121. Bottoms of the lateral walls 12 are recessed to form a pair of fixing recesses 131 located at fronts thereof, can be seen in FIG. 4.

The holding member 20 has two opposite edges extending downward to form a pair of fixing portions 201 at a front end thereof. Each fixing portion 201 has a second hole 202 and a third hole 203 formed thereon. The third hole 203 locates at a substantially middle portion of the fixing portion 201. The second hole 203 locates upside the third hole 203 and has a smaller dimension than the third hole 203. In assembly, the fixing portion 201 is inserted in the through slot 101, a rear of the holding member 20 is fixed on the file processing equipment.

The sensor holder 30 has a bottom slice 301. Two side edges of the bottom slice 301 respectively extend upward to form a pair of parallel lateral slices 303 defining a space therebetween. A substantially middle portion of the bottom slice 301 is recessed to form a slot 302 through the bottom slice 301 and extending forward and rearwards. A pair of positioning portions 304 protrude from the bottom slice 30 locating at two sides of the slot 302 symmetrically. The positioning portion 304 is recessed to form a positioning recess 305 extending upward and downwards and through a top thereof. Two sides of the sensor 40 engage with the positioning recesses 305 for assembling the sensor 40 to the sensor holder 30. A swing end 401 is movably assembled to a front of the sensor 40. The swing end 401 projects out of the slot 302 and is capable of swinging frontward and rearwards.

The lateral slice 303 has a forth hole 306 located at a front thereof crossing the whole sensor holder 30. Each lateral slice 303 has a top thereof recessed to form a fifth hole 307 located upside the forth hole 306. The forth hole 306 has a same dimension as the second hole 202. A bottom of the sensor holder 30 is recessed to form a plurality of holding recesses 308 for holding the pressing rollers 60.

A first shaft 21 passes through the first hole 201 and the third hole 203 for connecting the holding member 20 with the holding shell 30. A second shaft 31 passes through the forth hole 306 and has two opposite ends buckled in the fixing recesses 131 for fixing the sensor holder 30 in the holding shell 10.

A pair of connecting rods 50 is assembled to the holding shell 10. The connecting rod 50 has a rear end thereof protruding opposite to each other to form a pair of first protruding ends 51 and a front end thereof protruding opposite to each other to form a pair of second protruding ends 52. The first protruding end 51 engages with the second hole 202 and the second protruding ends 52 engages with the fifth holes 305 for connecting the holding member 20 with the sensor holder 30.

The connecting member 70 comprises a spring holder 72 and a torsion spring 71 held in the spring holder 72. A side of the torsion spring 71 extends frontward to form a fixing end 711. A side of the spring holder 72, the same side as the torsion spring 71, extends frontward to form a holding end 721. The connecting member 70 is rotationally sleeved on the first shaft 21 and rests against a lateral side of the holding shell 10. The fixing end 711 rests against a top of the projection 122 and the holding end 721 rests against a bottom of the projection 122. The fixing end 711 cooperates with the holding end 721 to firmly hold the projection 122, therefore, the rotation of the first shaft 21 can be transferred to the holding shell 10.

The fixing portion 201 is inserted in the through slot 101 and the first shaft 21 passes through the first hole 121 and the third hole 203. The connecting member 70 is sleeved on the first shaft 21 and firmly holds the projection 122. Therefore, the rotation of the first shaft 21 can be transferred to the holding shell 10. The sensor 40 is fixed in the sensor holder 30. The second shaft 31 passes through the forth hole 306 with two opposite ends thereof buckled in the fixing recess 131 for fixing the sensor holder 30 in the holding shell 10. The connecting rod 50 has a front end engaged with the sensor holder 30 and a rear end engaged with the holding member 20. Therefore, the holding shell 10, the holding member 20, the sensor holder 30 and the connecting rod 50 cooperates with each other to form a four-bar linkage mechanism. The four-bar linkage mechanism makes the sensor 40 be able to keep a certain angle respect to the sheets 200, assuring the measuring stability of the sensor 40.

FIGS. 5-7 describe the sheet feeding process of the sheet pressing apparatus 100. FIG. 5 shows an initiate state of the sheet pressing apparatus 100. The holding shell 10 is positioned in a raised position to form an opening for putting the sheets 200 on the input tray 300. The swing end 401 contacts with a front end of the slot 302 due to its own weight. The tip of the swing end 401 locates at a lower position than the rollers 60.

When a start button is pushed, the first shaft 21 rotates counter-clockwise driven by the stepping motor 2. The rotation of the first shaft 21 makes the connecting member 70 generate a certain torque which is pressed on the holding shell 10. As a result, the holding shell 10 swings counter-clockwise. Consequently, the holding shell 10 goes to descend. In the descending process, the sensor 40 is able to keep a certain angle respect to the horizontal direction due to the help of the four-bar linkage mechanism.

While the holding shell 10 descends close to the sheets 200, the swing end 401 firstly touches the sheet 200 and swings counter-clockwise. The sensor 40 detects the action of the swing end 401 and gives a signal to the control system 4. So, the control system 4 is able to figure out the thickness of the stack of the sheets 200 by calculating how many steps the stepping motor 2 having passed. Then, the control system 4 make the stepping motor 2 further go a certain time which is calculated by the control system 4 according to the thickness of the sheets 200, making the pressing rollers 60 press the sheets 200 in the vertical direction to apply a suitable pressure on the sheets 200.

As described above, the sensor 40 detects the thickness of the sheets 200 and gives the control system a signal, the control system makes the stepping motor further go a certain time to make the holding shell 10 descend and give the sheets 200 a suitable pressure. The holding shell 10, the holding member 20, the sensor holder 30 and the connecting rod 50 cooperate with each other to form a four-bar linkage mechanism making the sensor 40 be able to keep a certain angle respect to the sheets 200, so as to assure the measuring stability of the sensor 40.

What is claimed is:

1. A sheet pressing apparatus assembled on a file processing equipment, the file processing equipment including an input tray for stacking sheets and a pickup roller for feeding sheets, the sheet pressing apparatus comprising:

a sheet pressing assembly movably mounted to the file processing equipment;

a driving device including a connecting member and a stepping motor, the connecting member capable of making the sheet pressing assembly descend to press the sheets by a portion thereof with a force under the drive of the stepping motor;

a sensor unit assembled to the sheet pressing assembly; and a control system electrically connecting with the stepping motor and the sensor unit, wherein when the sheet pressing assembly descends, the sensor unit touches the sheets before the sheet pressing assembly touches the sheets and sends a signal to the control system, the control system figures out the thickness of the sheets by calculating the steps the stepping motor having passed, then the control system makes the stepping motor further move to drive the sheet pressing assembly to descend to apply a pressure on the sheets, wherein the sensor unit includes a sensor and a sensor holder assembled to the sheet pressing assembly for holding the sensor, wherein a bottom slice of the sensor holder is recessed to form a slot, the sensor unit further includes a swing end movably assembled to a lower portion of the sensor and stretches out of the slot, when the sheet pressing assembly descends, the swing end sensor unit firstly touches the sheets and then swings, the sensor detects the action of the swing end and gives the signal to the control system for figuring out the thickness of the sheets, wherein the sheet pressing assembly includes a holding shell and a pressing roller located in the holding shell, the sheet pressing assembly presses the sheets by the pressing roller, a distal end of the swing end is lower than the pressing roller, when the sheet pressing apparatus is in a raised position away from the sheets on the input tray, wherein the sheet pressing assembly further includes a holding member having a front thereof pivotally mounted to one end of the holding shell opposite to the sensor unit, and a rear thereof mounted on the file processing equipment, the sensor holder pivotally assembled in the holding shell for holding the sensor, a pair of connecting rods having a front end thereof pivotally connecting with the sensor holder and a rear end thereof pivotally connecting the holding member, then the holding shell, the holding member, the sensor holder and the connecting rod cooperates with each other to form a four-bar linkage.

2. The sheet pressing apparatus as claimed in claim 1, wherein the holding shell has a top wall, a pair of lateral walls extended from two opposite edges of the top wall, the top wall defines a pair of through slots symmetrically located at a rear thereof, a rear of the lateral wall defines a first hole crossing the entire holding shell and intersecting with the through slots, bottoms of the lateral walls are recessed to form a pair of fixing recesses at fronts thereof, two opposite edges of the holding member is extended to form a pair of fixing portions, the fixing portion defines a third hole and a second hole located upside the third hole, the fixing portion is inserted into the through slot, a first shaft passes through the first hole and the third holes for connecting the holding shell with the holding member, the sensor holder defines a fourth hole crossing the entire sensor holder and two fifth holes at two lateral slices thereof and upside the fourth hole, a second shaft passes through the fourth hole and has two opposite ends thereof buckled in the fixing recesses, for mounting the sensor holder in the holding shell, a front of the connecting rod engages with the fifth hole, a rear of the connecting rod engages with the second hole.

3. The sheet pressing apparatus as claimed in claim 2, wherein the connecting member is rotationally sleeved on the first shaft, the connecting member includes a spring holder and a torsion spring held in the spring holder, a middle portion of one lateral wall protrudes outward to form a projection adjacent to the first hole, a side of the torsion spring extends frontward to form a fixing end resting against a top of the projection, a side of the spring holder extends frontward to form a holding end resting against a bottom of the projection, the fixing end cooperates with the holding end to firmly hold the projection.

* * * * *